US009587644B2

(12) United States Patent
Higashio et al.

(10) Patent No.: US 9,587,644 B2
(45) Date of Patent: Mar. 7, 2017

(54) COMPRESSOR AND METHOD OF ASSEMBLING THE SAME

(75) Inventors: Atsushi Higashio, Hiroshima (JP); Kazumi Matsubayashi, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 621 days.

(21) Appl. No.: 13/990,229

(22) PCT Filed: Aug. 3, 2011

(86) PCT No.: PCT/JP2011/067782
§ 371 (c)(1),
(2), (4) Date: May 29, 2013

(87) PCT Pub. No.: WO2012/114559
PCT Pub. Date: Aug. 30, 2012

(65) Prior Publication Data

US 2013/0243582 A1 Sep. 19, 2013

(30) Foreign Application Priority Data

Feb. 25, 2011 (JP) ..... 2011-040582

(51) Int. Cl.
*F04D 29/08* (2006.01)
*F04D 29/42* (2006.01)
(Continued)

(52) U.S. Cl.
CPC ..... *F04D 29/08* (2013.01); *F04D 17/122* (2013.01); *F04D 19/02* (2013.01); *F04D 29/083* (2013.01);
(Continued)

(58) Field of Classification Search
CPC ..... F01D 11/04; F04D 17/122; F04D 29/60; F04D 29/601; F04D 29/646; F04D 29/083;
(Continued)

(56) References Cited

U.S. PATENT DOCUMENTS 1,923,126 A 8/1933 Tucker
2,722,373 A * 11/1955 Ledwith ..... F01D 9/042 415/209.1
(Continued)

FOREIGN PATENT DOCUMENTS

CN 1453452 11/2003
CN 201281047 7/2009
(Continued)

OTHER PUBLICATIONS

Office Action issued Feb. 4, 2015 in corresponding Chinese patent application No. 201180056947.9 (with English translation).
(Continued)

*Primary Examiner* — Richard Edgar
*Assistant Examiner* — Christopher R Legendre
(74) *Attorney, Agent, or Firm* — Wenderoth, Lind & Ponack, L.L.P.

(57) ABSTRACT

A compressor casing, a compressor provided with the same, and a method of assembling the compressor are provided. The compressor casing includes a substantially tubular casing, a plurality of sealing surfaces provided on an inner circumferential surface of the compressor casing along an axial direction thereof, a sealing means provided for each of the plurality sealing surfaces, a substantially cylindrical bundle for accommodating a blade inside and for being assembled to the compressor casing so as to have contact with the plurality of sealing surfaces, and a roller provided on an outer circumferential surface of the substantially
(Continued)

cylindrical bundle, for rolling on the inner circumferential surface of the compressor casing when the substantially cylindrical bundle is assembled to or removed from the compressor casing. The sealing surfaces are connected with one another with tapered surfaces.

4 Claims, 3 Drawing Sheets

(51) Int. Cl.

| | |
|---|---|
| ***F04D 29/52*** | (2006.01) |
| ***F04D 29/62*** | (2006.01) |
| ***F04D 29/64*** | (2006.01) |
| ***F04D 19/02*** | (2006.01) |
| ***F04D 17/12*** | (2006.01) |

(52) U.S. Cl.
CPC ..... *F04D 29/4206* (2013.01); *F04D 29/522* (2013.01); *F04D 29/624* (2013.01); *F04D 29/644* (2013.01); *Y10T 29/49236* (2015.01)

(58) Field of Classification Search
CPC ..... F04D 29/42; F04D 29/4206; F04D 29/52; F04D 29/522; F04D 29/624; F04D 29/644; F05D 2230/60; F05D 2230/64; F05D 2230/644; F05D 2230/68; F05D 2230/70; F02C 7/20; Y10T 29/49236
See application file for complete search history.

(56) References Cited

U.S. PATENT DOCUMENTS

| | | | | |
|---|---|---|---|---|
| 3,150,820 | A | 9/1964 | Jekat et al. | |
| 4,044,442 | A | 8/1977 | Carlson | |
| 5,971,702 | A * | 10/1999 | Afton | B23P 19/022 29/888.011 |
| 7,011,490 | B2 * | 3/2006 | Albrecht | F01D 21/045 415/174.4 |
| 8,974,176 | B2 * | 3/2015 | Sasaki | F04D 17/122 415/199.2 |
| 2013/0243582 | A1 * | 9/2013 | Higashio | F04D 29/4206 415/182.1 |

FOREIGN PATENT DOCUMENTS

| | | | | |
|---|---|---|---|---|
| CN | 201606307 | | 10/2010 | |
| DE | 26 56 826 | | 3/1978 | |
| DE | 27 19 850 | | 11/1978 | |
| DE | 196 17 090 | | 10/1997 | |
| DE | 297 19 605 | | 12/1997 | |
| DE | 297 19 605 | | 2/1998 | |
| DE | 199 19 650 | | 12/1999 | |
| DE | 199 27 765 | | 12/2000 | |
| DE | EP 2045472 | A1 * | 4/2009 | B23P 19/022 |
| EP | 0 050 796 | | 5/1982 | |
| GB | 1 350 657 | | 4/1974 | |
| GB | 2 199 461 | | 7/1988 | |
| JP | 62-190900 | | 12/1987 | |
| JP | 10-220399 | | 8/1998 | |
| JP | 11-270499 | | 10/1999 | |

OTHER PUBLICATIONS

Partial English translation of International Search Report issued Oct. 18, 2011 in International (PCT) Application No. PCT/JP2011/067782.

Partial English translation of Written Opinion of the International Searching Authority issued Oct. 18, 2011 in International Application No. PCT/JP2011/067782.

Notification of Grant of Invention Patent issued Oct. 20, 2015 in corresponding Chinese patent application No. 201180056947.9 (with partial English translation).

Notification issued Aug. 26, 2014 in corresponding European patent application No. 11859169.

Decision to Grant a Patent issued Jan. 21, 2014 in corresponding Japanese patent application No. 2011-040582.

* cited by examiner

COMPRESSOR AND METHOD OF ASSEMBLING THE SAME

TECHNICAL FIELD

The present invention relates to a vertical split type (barrel) compressor and a method of assembling the same, and more particularly, to a structure of a compressor casing.

BACKGROUND ART

Generally, a vertical split type compressor is structured so as to allow assemblage or removal of a substantially cylindrical bundle accommodating its components, such as a rotor, a blade and the like, into or from a substantially tubular compressor casing (hereinafter, referred to as a "casing") along an axial direction of the casing (for example, Japanese Unexamined Patent Application, Publication No. H11-270499).

As shown in FIG. 3, the inner circumferential surface of the casing 3' of a conventional compressor 1' is provided with a plurality of steps so that the inner diameter becomes smaller toward the tip end portion of the bundle 2'(on the right side in FIG. 3) so as to minimize the clearance between the casing 3' and bundle 2' at the deepest insertion position of the bundle 2'. Also, the outer circumferential surface of the bundle 2' is provided with a plurality of sealing portions 5' that contact with sealing surfaces (not shown) provided on the inner circumferential surface of the casing 3' when the bundle 2' is assembled to the casing 3', and O-rings 7' are provided on the outer circumferential surfaces of the sealing portions 5'. Each sealing portion 5' and each sealing surface contact with each other via the O-ring 7' in the aforementioned manner to thereby prevent leakage of a compressed material from a gap (not shown) formed between the inner circumferential surface of the casing 3' and the outer circumferential surface of the bundle 2'.

Technical Problem

The outer circumferential surface of the bundle is provided with a bundle roller at the lower side and near the tip end portion in the direction of assemblage of the bundle into the casing. At the time of assembling a conventional vertical split type compressor 1' shown in FIG. 3 or the compressor disclosed in Japanese Unexamined Patent Application, Publication No. H11-270499, the bundle 2 is assembled to the casing 3, using the bundle roller (not shown) which rolls on the inner circumferential surface of the casing 3. However, steps are provided on the inner circumferential surface of the casing 3, and therefore it is difficult for the bundle roller to move over each step.

Also, a great contact pressure is applied to a corner of each step formed on the inner circumferential surface of the casing 3 when the bundle roller moves over each step. Accordingly, a flaw may possibly occur on the surface of the bundle roller or on the inner circumferential surface of the casing 3. If a flaw is present on the inner circumferential surface of the casing 3, a compressed material may possibly leak from the flaw even if the inner circumferential surface of the casing 3 and the outer circumferential surface of the bundle 2 are sealed by the O-ring 7.

SUMMARY OF INVENTION

The present invention is made in view of the circumstances described above, and provides a compressor that may be easily assembled, and a method of assembling the same.

Solution to Problem

To make improvements in the circumstances described above, the compressor of the present invention and the method of assembling the same adopt the following solutions.

A first aspect of the present invention is a compressor including a substantially tubular casing; a plurality of sealing surfaces provided on an inner circumferential surface of the casing along an axial direction thereof; two or more sealing portions configured to extend in a circumferential direction, each of which comes into contact with each of the sealing surfaces; a substantially cylindrical bundle accommodating a blade inside, for being assembled to the casing so as to have contact with the sealing surfaces; and a roller provided on an outer circumferential surface of the bundle, for rolling on the inner circumferential surface of the casing when the bundle is assembled to or removed from the casing, wherein a portion between the sealing surfaces is formed in a tapered manner to connect the sealing surfaces, and the portion is tapered off in a direction of assemblage of the bundle.

The portion between the plurality of sealing surfaces provided along the axial direction of the casing is formed in a tapered manner to connect the sealing surfaces on the inner circumferential surface of the casing into which the bundle accommodating a blade inside is to be assembled, and the portion is tapered off in the direction of assemblage of the bundle. Thus, the roller provided on the outer circumferential surface of the bundle can roll smoothly on the inner circumferential surface of the casing at the time of assemblage of the bundle into the casing or removal of the bundle from the casing. Accordingly, the bundle can be assembled or removed without causing a scratch on the inner circumferential surface of the casing. Thus, the sealing property between the inner circumferential surface of the casing and the outer circumferential surface of the bundle is not deteriorated at the time of assemblage of the bundle into the casing.

Also, since the portion between the sealing surfaces is formed in a tapered manner to connect the sealing surfaces on the inner circumferential surface of the casing, and the portion is tapered off in the direction of assemblage of the bundle, the bundle can be easily assembled to the casing. Accordingly, an assembly work of a compressor conventionally performed by an expert may be easily performed by a nonexpert.

A second aspect of the present invention is a method of assembling a compressor, the compressor is configured to include: a substantially tubular casing; a plurality of sealing surfaces provided on an inner circumferential surface of the casing along an axial direction thereof; two or more sealing portions configured to extend in a circumferential direction, each of which comes into contact with each of the sealing surfaces; a substantially cylindrical bundle accommodating a blade inside, for being assembled to the casing so as to have contact with the sealing surfaces; and a roller provided on an outer circumferential surface of the bundle, wherein a portion between the sealing surfaces is formed in a tapered manner to connect the sealing surfaces and the portion is tapered off in a direction of assemblage of the bundle, wherein the bundle is assembled into or removed from the casing, using the roller provided on the outer circumferential surface of the bundle which rolls on the inner circumferential surface of the casing.

Advantageous Effects of Invention

The portion between the plurality of sealing portions provided along the axial direction of the casing is formed in a tapered manner to connect the sealing portions on the inner circumferential surface of the casing into which the bundle accommodating a blade inside is to be assembled, and the portion is tapered off in the direction of assemblage of the bundle. Therefore, the roller provided on the outer circumferential surface of the bundle can roll smoothly on the inner circumferential surface of the casing at the time of assemblage of the bundle into the casing or removal of the bundle from the casing. Accordingly, the bundle can be assembled or removed without causing a scratch on the inner circumferential surface of the casing. Thus, the sealing property between the inner circumferential surface of the casing and the outer circumferential surface of the bundle is not deteriorated at the time of assemblage of the bundle into the casing.

Also, since the portion between the sealing surfaces is formed in a tapered manner to connect the sealing surfaces on the inner circumferential surface of the casing, and the portion is tapered off in the direction of assemblage of the bundle, the bundle can be easily assembled to the casing. Accordingly, an assembly work of a compressor conventionally performed by an expert may be easily performed by a nonexpert.

DESCRIPTION OF EMBODIMENTS

Figure 1:
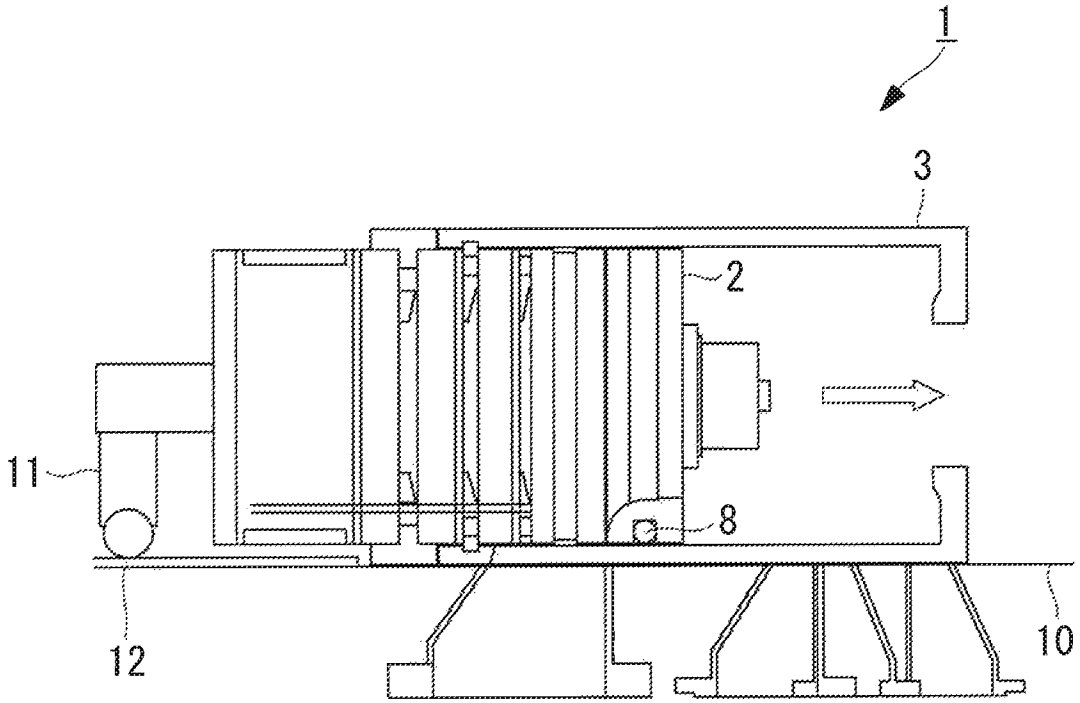
FIG. 1 is a diagram showing assemblage of a compressor bundle into a casing.
Figure 2:
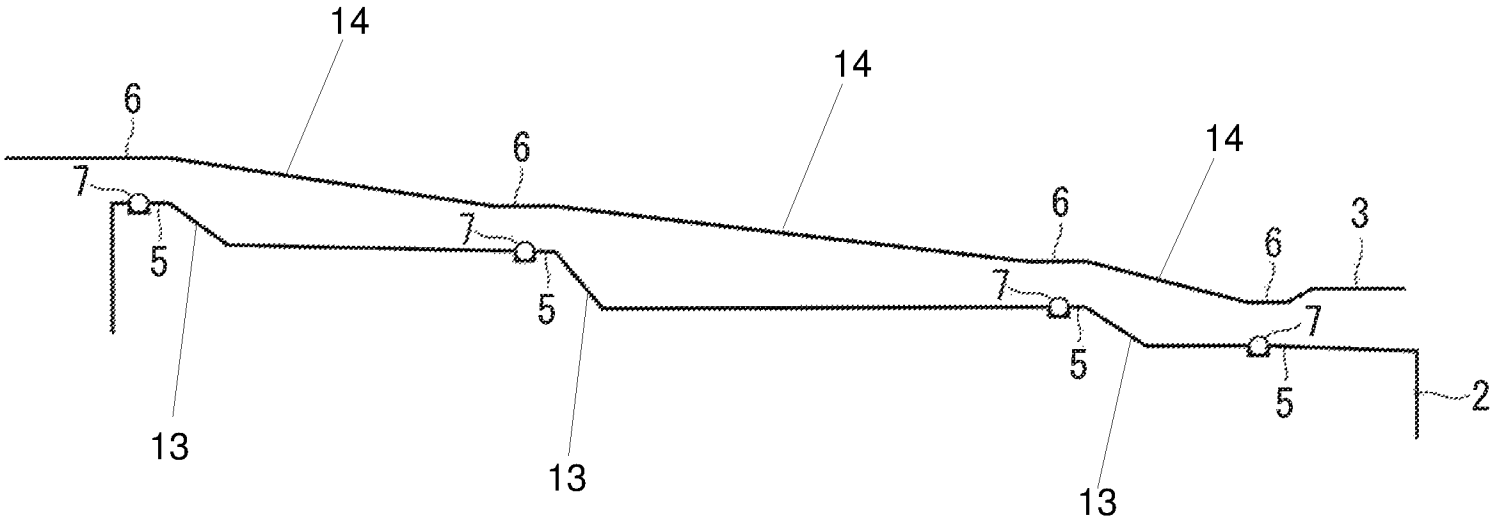
FIG. 2 is a partially enlarged view of a portion between the bundle and the casing shown in FIG. 1 according to the present invention.
Figure 3:
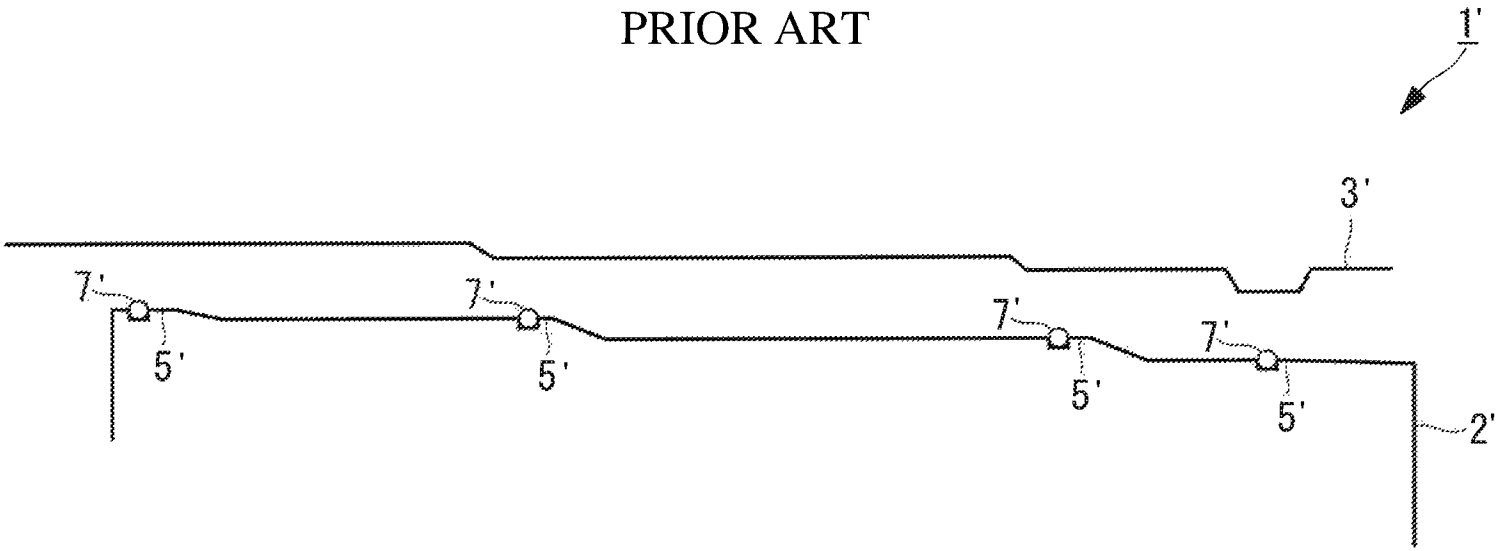
FIG. 3 PRIOR ART
FIG. 3 is a partially enlarged view of a portion between a bundle and a casing according to a conventional technique.

FIG. 1 shows assemblage of a compressor bundle into a casing, and FIG. 2 shows a partially enlarged view of a portion between the bundle and the casing shown in FIG. 1 according to the present invention.

A vertical split type (hereinafter, referred to as "barrel type") compressor 1 is mainly structured from a substantially cylindrical bundle 2 accommodating inside components thereof, such as a rotor (not shown) and the like, and a substantially tubular compressor casing (hereinafter, referred to as a "casing") 3.

The bundle 2 is substantially cylindrical, and has a bundle roller (a roller) 8 provided on the lower side of the outer circumferential surface of the bundle 2 and near a tip end portion of the bundle 2 (that is, the right side in FIG. 1). When seen in an enlarged view, the outer circumferential surface of the substantially cylindrical bundle 2 has, as shown in FIG. 2, a plurality of sealing portions 5 (four sealing positions in FIG. 2) along the axial direction of the bundle 2, and the bundle 2 is tapered off due to the presence of tapered surfaces 13, from the left side in FIG. 2 toward the right side. Each of the plurality of sealing portions 5 provided on the outer circumferential surface of the bundle 2 is substantially parallel to a sealing portion (a sealing surface) 6 of the casing 3 described below. An O-ring (a sealing means) 7 is provided on the outer circumferential surface of each sealing portion so as to extend in the circumferential direction of the bundle 2.

The bundle 2 can be assembled to the casing 3 or be removed from the casing 3 with the bundle roller 8 (see FIG. 1) or bundle rollers, which are provided on the lower side of the outer circumferential surface of the bundle 2 and near the tip end portion of the bundle 2 and which roll on the inner circumferential surface of the casing 3.

The casing 3 is substantially tubular, and is capable of accommodating the bundle 2 inside, as shown in FIG. 1. When seen in an enlarged view, the inner circumferential surface of the casing 3 is tapered due to the presence of tapered surfaces 14, with its inner diameter decreasing in the direction of insertion of the bundle 2 (that is, from the left side toward the right side in FIG. 2), as shown in FIG. 2.

The tapered inner circumferential surface of the casing 6 is provided with sealing portions 6 at positions corresponding to the sealing portions 5 provided on the outer circumferential surface of the bundle 2 (at four positions in FIG. 2). A plurality of sealing portions 6 are provided (for example, at four positions) along the axial direction of the casing 3.

Each sealing portion 6 is substantially parallel to the sealing portion 5 of the bundle 2 so that the sealing property with the outer circumferential surface of the bundle 2 via the O-ring 7 may be maintained after assemblage of the bundle 2 into the casing 3. Each tapered surface is steeper than each tapered surface 14.

Next, a method of the present invention of assembling the bundle 2 into the casing 3 will be described.

As shown in FIG. 1, the casing 3 is placed on a mount 10 in such a way that the axial direction of the casing 3 becomes substantially parallel to the upper surface of the mount 10.

Next, a bundle roller 11 for assemblage is installed at an axial end portion of the bundle 2 so as to extend downward and beyond the line of the outer circumferential surface, and the axial end portion is facing the opposite side relative to the direction of assemblage into the casing 3. A tip end portion of the bundle roller 11 for assemblage is capable of rolling on a rail 12 installed on the upper surface of the mount 10. The bundle 2 is assembled to the casing 3 with its weight supported, by the bundle roller 11 for assemblage and the bundle roller 8 provided on the lower side on the outer circumferential surface of the bundle 2 and near the tip end portion of the bundle 2.

As shown in FIG. 2, the sealing portions 6 on the inner circumferential surface of the casing 3 are connected with one another in a tapered manner, and the inner diameter of the casing 3 is reduced in the direction of assemblage of the bundle 2. The bundle roller 8 (see FIG. 1) provided to the bundle 2 can thereby move smoothly on the inner circumferential surface of the casing 3 at the time of assemblage of the bundle 2 into the casing 3. Accordingly, the bundle 2 is easily assembled to the casing 3.

As described above, according to the compressor 1 and the method of assembling the same according to the present embodiment, the following effects can be achieved.

Since a plurality of sealing portions (sealing surfaces) 6 provided (at four positions, for example) along the axial direction of the casing 3 are connected with one another with tapered surfaces, the sealing portions 6 being provided on the inner circumferential surface of the casing 3 into which the bundle 2 accommodating inside a blade (not shown) or the like is to be assembled, and the inner diameter of the casing 3 is reduced toward the direction of assemblage of the bundle 2, The bundle roller (the roller) 8 provided on the outer circumferential surface of the bundle 2 can thereby roll smoothly on the inner circumferential surface of the casing 3 at the time of assemblage of the bundle 2 into the casing 3 or removal of the bundle 2 from the casing 3. Accordingly, the inner circumferential surface of the casing 3 is not scratched at the time of assemblage or removal of the bundle 2. Thus, the sealing property between the inner circumferential surface of the casing 3 and the outer circumferential surface of the bundle 2 is not deteriorated.

Also, since the sealing portion 6 are connected with one another with tapered surfaces on the inner circumferential surface of the casing 3, and the inner diameter of the casing 3 is reduced in the direction of assemblage of the bundle 2, the bundle is easily assembled into the casing 3. Accordingly, an assembly work of the compressor 1 conventionally performed by an expert may be easily performed by a nonexpert.

REFERENCE SIGNS LIST

1 Compressor
2 Bundle
3 Casing
6 Sealing surface (Sealing portion)
7 Sealing means (O-ring)
8 Roller (Bundle roller)

The invention claimed is:

1. A compressor comprising:
a substantially tubular casing;
a substantially cylindrical bundle accommodating a blade inside, for being assembled to the casing; and
a roller provided on an outer circumferential surface of the bundle, for rolling on an inner circumferential surface of the casing when the bundle is assembled to or removed from the casing,
wherein the casing comprises a plurality of sealing surfaces provided on the inner circumferential surface of the casing so that the sealing surfaces are arranged in series along an axial direction of the casing with an interval between each of successive sealing surfaces,
wherein the bundle comprises:
sealing portions which are provided on the outer circumferential surface of the bundle and which face the sealing surfaces, respectively, when the bundle is assembled to the casing,
two or more sealing means which are provided on respective outer circumferential surfaces of the sealing portions and are configured to extend along a circumferential direction of the casing, and come into contact with the sealing surfaces, respectively, when the bundle is assembled to the casing,
wherein a distance of each interval is longer than a length of each of successive sealing surfaces, and
wherein each interval is defined by a respective portion of the casing which connects successive sealing surfaces to each other that is tapered off as a whole in a direction of assemblage of the bundle and has a gradual inclination relative to an axis of the bundle.

2. The compressor according claim 1, wherein:
the sealing portions are arranged in series along an axial direction of the bundle with an interval between each of successive sealing portions being defined by a respective portion of the bundle which connects successive sealing portions to each other that is tapered off as a whole in the direction of assemblage of the bundle, and
each respective portion of the bundle which connects successive sealing portions to each other has an inclination angle, respectively, that is steeper than each respective portion of the casing which connects successive sealing surfaces to each other.

3. A method of assembling a compressor, wherein the compressor is configured to include:
a substantially tubular casing;
a substantially cylindrical bundle accommodating a blade inside, for being assembled to the casing; and
a roller provided on an outer circumferential surface of the bundle,
wherein the casing comprises a plurality of sealing surfaces provided on an inner circumferential surface of the casing so that the sealing surfaces are arranged in series along an axial direction of the casing with an interval between each of successive sealing surfaces,
wherein the bundle comprises:
sealing portions which are provided on the outer circumferential surface of the bundle and which face the sealing surfaces, respectively, when the bundle is assembled to the casing,
two or more sealing means which are provided on respective outer circumferential surfaces of the sealing portions and are configured to extend along a circumferential direction of the casing, and come into contact with the sealing surfaces, respectively, when the bundle is assembled to the casing,
wherein a distance of each interval is longer than a length of each of successive sealing surfaces,
wherein each interval is defined by a respective portion of the casing which connects successive sealing surfaces to each other that is tapered off as a whole in a direction of assemblage of the bundle and has a gradual inclination relative to an axis of the bundle, and
wherein the bundle is assembled into or removed from the casing, using the roller provided on the outer circumferential surface of the bundle which rolls on the inner circumferential surface of the casing.

4. The method according claim 3, wherein:
the sealing portions are arranged in series along an axial direction of the bundle with an interval between each of successive sealing portions being defined by a respective portion of the bundle which connects successive sealing portions to each other that is tapered off as a whole in the direction of assemblage of the bundle, and
each respective portion of the bundle which connects successive sealing portions to each other has an inclination angle, respectively, that is steeper than each respective portion of the casing which connects successive sealing surfaces to each other.

* * * * *